US010612563B2

(12) United States Patent
Sato

(10) Patent No.: US 10,612,563 B2
(45) Date of Patent: Apr. 7, 2020

(54) BLOWER AND AIR CONDITIONER HAVING THE SAME

(71) Applicant: Samsung Electronics Co., Ltd., Suwon-si (KR)

(72) Inventor: Seiji Sato, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 208 days.

(21) Appl. No.: 15/738,394

(22) PCT Filed: Jul. 10, 2015

(86) PCT No.: PCT/KR2015/007209
§ 371 (c)(1),
(2) Date: Dec. 20, 2017

(87) PCT Pub. No.: WO2017/010578
PCT Pub. Date: Jan. 19, 2017

(65) Prior Publication Data

US 2018/0180060 A1 Jun. 28, 2018

(30) Foreign Application Priority Data

Jul. 10, 2015 (KR) ..... 10-2015-0098101

(51) Int. Cl.
*F25D 17/06* (2006.01)
*F04D 29/54* (2006.01)
(Continued)

(52) U.S. Cl.
CPC ..... *F04D 29/542* (2013.01); *F04D 25/08* (2013.01); *F04D 29/38* (2013.01); *F04D 29/547* (2013.01);
(Continued)

(58) Field of Classification Search
CPC ..... F04D 29/542; F04D 29/38; F04D 29/563; F04D 25/08; F04D 25/06; F04D 25/542;
(Continued)

(56) References Cited

U.S. PATENT DOCUMENTS 6,398,492 B1 * 6/2002 Cho ..... F04D 29/544 415/191
2007/0122271 A1 5/2007 Ishihara et al.
2014/0245776 A1 * 9/2014 Choi ..... F24F 1/38 62/426

FOREIGN PATENT DOCUMENTS

CN 1975180 A 6/2007
JP 2001-289466 10/2001
(Continued)

OTHER PUBLICATIONS

International Search Report dated Mar. 24, 2016 in corresponding International Patent Application No. PCT/KR2015/007209.
(Continued)

*Primary Examiner* — Henry T Crenshaw
*Assistant Examiner* — Kamran Tavakoldavani
(74) *Attorney, Agent, or Firm* — Staas & Halsey LLP

(57) ABSTRACT

An air conditioner comprises a compressor to compress a refrigerant, a heat exchanger to move heat of the refrigerant, and a blower to blow air. The blower comprises a fan rotatable about a rotation axis, and a plurality of stationary blades installed to be a radial shape about the rotation axis in a direction in which the airflow generated by the rotation of the fan is discharged, and are curved in a direction opposite to the rotation direction of the fan from an inner circumferential portion to an outer circumferential portion. The stationary blades comprise an inlet edge, and an outlet edge, and an inlet angle formed by the inlet edge and the rotation axis and a chord angle formed by a chord connect-
(Continued)

ing the inlet edge and the outlet edge and the rotation axis are larger at the inner and outer circumferential portions than at a radial center portion.

15 Claims, 9 Drawing Sheets

(51) Int. Cl.

| | |
|---|---|
| ***F24F 1/14*** | (2011.01) |
| ***F24F 1/38*** | (2011.01) |
| ***F04D 29/38*** | (2006.01) |
| ***F24F 1/08*** | (2011.01) |
| ***F24F 1/40*** | (2011.01) |
| ***F04D 25/08*** | (2006.01) |
| ***F04D 29/56*** | (2006.01) |
| ***F25B 13/00*** | (2006.01) |
| *F04D 25/06* | (2006.01) |

(52) U.S. Cl.
CPC ..... *F04D 29/563* (2013.01); *F24F 1/08* (2013.01); *F24F 1/14* (2013.01); *F24F 1/38* (2013.01); *F24F 1/40* (2013.01); *F25B 13/00* (2013.01); *F25D 17/067* (2013.01); *F04D 25/06* (2013.01)

(58) Field of Classification Search
CPC ..... F24F 1/08; F24F 1/14; F24F 1/38; F24F 1/40; F24F 1/50; F24F 1/56; F24F 13/20; F24F 13/081; F24F 13/082; F24F 2013/205; F25B 13/00
See application file for complete search history.

(56) References Cited

FOREIGN PATENT DOCUMENTS

| | | |
|---|---|---|
| JP | 2008-303778 | 12/2008 |
| JP | 2013-119816 | 6/2013 |
| JP | 2015-108316 | 6/2015 |
| KR | 10-2015-0063944 | 6/2015 |
| WO | 2013/055036 | 4/2013 |
| WO | 2015/083371 | 6/2015 |
| WO | 2015/084030 | 6/2015 |

OTHER PUBLICATIONS

Written Opinion of the International Searching Authority dated Mar. 24, 2016 in corresponding International Patent Application No. PCT/KR2015/007209.
Extended European Search Report dated Oct. 25, 2018 in European Patent Application No. 15898339.5.
Chinese Office Action dated Aug. 5, 2019 from Chinese Patent Application No. 201580081562.6, 27 pages.

* cited by examiner

BLOWER AND AIR CONDITIONER HAVING THE SAME

CROSS-REFERENCE TO RELATED APPLICATIONS

This application is a U.S. National Stage Application which claims the benefit under 35 U.S.C. § 371 of International Patent Application No. PCT/KR2015/007209, filed on Jul. 10, 2015, which claims the foreign priority benefit under 35 U.S.C. § 119 of Korean Patent Application No. 10-2015-0098101 filed Jul. 10, 2015, the contents of which are incorporated herein by reference.

TECHNICAL FIELD

The present disclosure relates to a blower and an air conditioner having the same.

BACKGROUND ART

A blower used in an outdoor unit of an air conditioner includes a rotating fan having a plurality of moving blades, an electric motor for driving the fan, and a plurality of stationary blades installed in a direction in which the airflow generated by the rotation of the fan is discharged.

The airflow generated by the rotation of the fan having a plurality of moving blades is generally different in the blowing direction depending on the radial direction position of the fan.

In addition, depending on the difference of the shape of the stationary blades installed in the direction in which the airflow generated by the rotation of the fan is discharged, the dynamic pressure of the airflow generated by the rotation of the fan may not be effectively recovered and the static pressure efficiency of the blower may be lowered.

DISCLOSURE OF INVENTION

Technical Problem

Therefore, it is an aspect of the present disclosure to provide a blower and an air conditioner having the same which improve the static pressure efficiency by improving the shape of stationary blades installed in the direction in which the airflow generated by the rotation of a fan is discharged.

Technical Solution

An air conditioner in accordance with an embodiment of the present disclosure includes a compressor to compress a refrigerant, a heat exchanger to move heat of the refrigerant, and a blower to blow air so as to cool the heat exchanger, wherein the blower includes a fan which is rotated about a rotation axis, and a plurality of stationary blades which are installed to be a radial shape about the rotation axis in a direction in which the airflow generated by the rotation of the fan is discharged, and are curved in a direction opposite to the rotation direction of the fan as they go from an inner circumferential portion to an outer circumferential portion, the stationary blades include an inlet edge through which the airflow generated by the fan is introduced, and an outlet edge through which the airflow introduced into the inlet edge is discharged, and an inlet angle formed by the inlet edge and the rotation axis and a chord angle formed by a chord connecting the inlet edge and the outlet edge and the rotation axis are larger at the inner circumferential portion and the outer circumferential portion than at a radial center portion between the inner circumferential portion and the outer circumferential portion.

The stationary blades may be continuously changed in accordance with the radial direction position such that the inlet angle corresponds to the velocity distribution of the airflow generated by the rotation of the fan.

The stationary blades may be continuously changed in accordance with the radial direction position such that the chord angle corresponds to the inlet angle and the velocity distribution of the airflow generated by the rotation of the fan.

The stationary blades may have a larger outlet angle which is formed by the outlet edge and the rotation axis, at the inner circumferential portion and the outer circumferential portion than at the radial center portion between the inner circumferential portion and the outer circumferential portion.

The stationary blades may have a longer length of the chord at the inner circumferential portion and the outer circumferential portion than at the radial center portion between the inner circumferential portion and the outer circumferential portion.

The stationary blades may be continuously changed in accordance with the radial direction position such that the outlet angle and the length of the chord correspond to the inlet angle and the velocity distribution of the airflow generated by the rotation of the fan.

The air conditioner may further include an electric motor to drive the fan, a first housing to house the fan and the electric motor, and a second housing provided with the stationary blades.

The first housing may have a cylindrical inner wall surface, a flow passage through which the airflow generated by the fan passes along the inner wall surface may be formed inside the first housing, and the cross-sectional area of the flow passage may be reduced along the advancing direction of the airflow.

The second housing may have a cylindrical inner wall surface, a flow passage through which the airflow after passing through the first housing passes along the inner wall surface may be formed inside the second housing, and the cross-sectional area of the flow passage may be increased along the advancing direction of the airflow.

The stationary blades may be provided to extend to a connecting member provided adjacent to the rotation axis from the inner wall surface and may be provided in a plate shape having a uniform thickness from the inner circumferential portion contacting with the connecting member to the outer circumferential portion contacting with the inner wall surface.

A ring-shaped supporting member to support the stationary blades may be provided between the inner wall surface and the connecting member, and the stationary blades may include inner circumferential stationary blades connecting the connecting member and the supporting member, and outer circumferential stationary blades connecting the supporting member and the inner wall surface.

The outer circumferential stationary blades may be provided to have a larger number than the number of the inner circumferential stationary blades.

Further, an air conditioner in accordance with an embodiment of the present disclosure includes a compressor to compress a refrigerant, a heat exchanger to move heat of the refrigerant, and a blower to blow air so as to cool the heat exchanger, wherein the blower includes a fan which is rotated about a rotation axis, and a plurality of stationary blades which are installed to be a radial shape about the rotation axis in a direction in which the airflow generated by the rotation of the fan is discharged, and are curved in a direction opposite to the rotation direction of the fan as they go from an inner circumferential portion to an outer circumferential portion, the stationary blades include an inlet edge through which the airflow generated by the fan is introduced, and an outlet edge through which the airflow introduced into the inlet edge is discharged, an inlet angle formed by the inlet edge and the rotation axis is larger at the inner circumferential portion and the outer circumferential portion than at a radial center portion between the inner circumferential portion and the outer circumferential portion, and the length of a chord connecting the inlet edge and the outlet edge is longer at the inner circumferential portion and the outer circumferential portion than at the radial center portion.

Further, a blower in accordance with an embodiment of the present disclosure includes a fan which is rotated about a rotation axis, and a plurality of stationary blades which are installed to be a radial shape about the rotation axis in a direction in which the airflow generated by the rotation of the fan is discharged, and are curved in a direction opposite to the rotation direction of the fan as they go from an inner circumferential portion to an outer circumferential portion, wherein the stationary blades include an inlet edge through which the airflow generated by the fan is introduced, and an outlet edge through which the airflow introduced into the inlet edge is discharged, and an inlet angle formed by the inlet edge and the rotation axis and a chord angle formed by a chord connecting the inlet edge and the outlet edge and the rotation axis are larger at the inner circumferential portion and the outer circumferential portion than at a radial center portion between the inner circumferential portion and the outer circumferential portion.

Further, a blower in accordance with an embodiment of the present disclosure includes a fan which is rotated about a rotation axis, and a plurality of stationary blades which are installed to be a radial shape about the rotation axis in a direction in which the airflow generated by the rotation of the fan is discharged, and are curved in a direction opposite to the rotation direction of the fan as they go from an inner circumferential portion to an outer circumferential portion, wherein the stationary blades include an inlet edge through which the airflow generated by the fan is introduced, and an outlet edge through which the airflow introduced into the inlet edge is discharged, an inlet angle formed by the inlet edge and the rotation axis is larger at the inner circumferential portion and the outer circumferential portion than at a radial center portion between the inner circumferential portion and the outer circumferential portion, and the length of a chord connecting the inlet edge and the outlet edge is longer at the inner circumferential portion and the outer circumferential portion than at the radial center portion.

Advantageous Effects

In accordance with the embodiments of the present disclosure, the static pressure efficiency of a blower can be improved.

MODE FOR INVENTION

Hereinafter, embodiments of the present disclosure will be described in detail with reference to the accompanying drawings.

Figure 1:
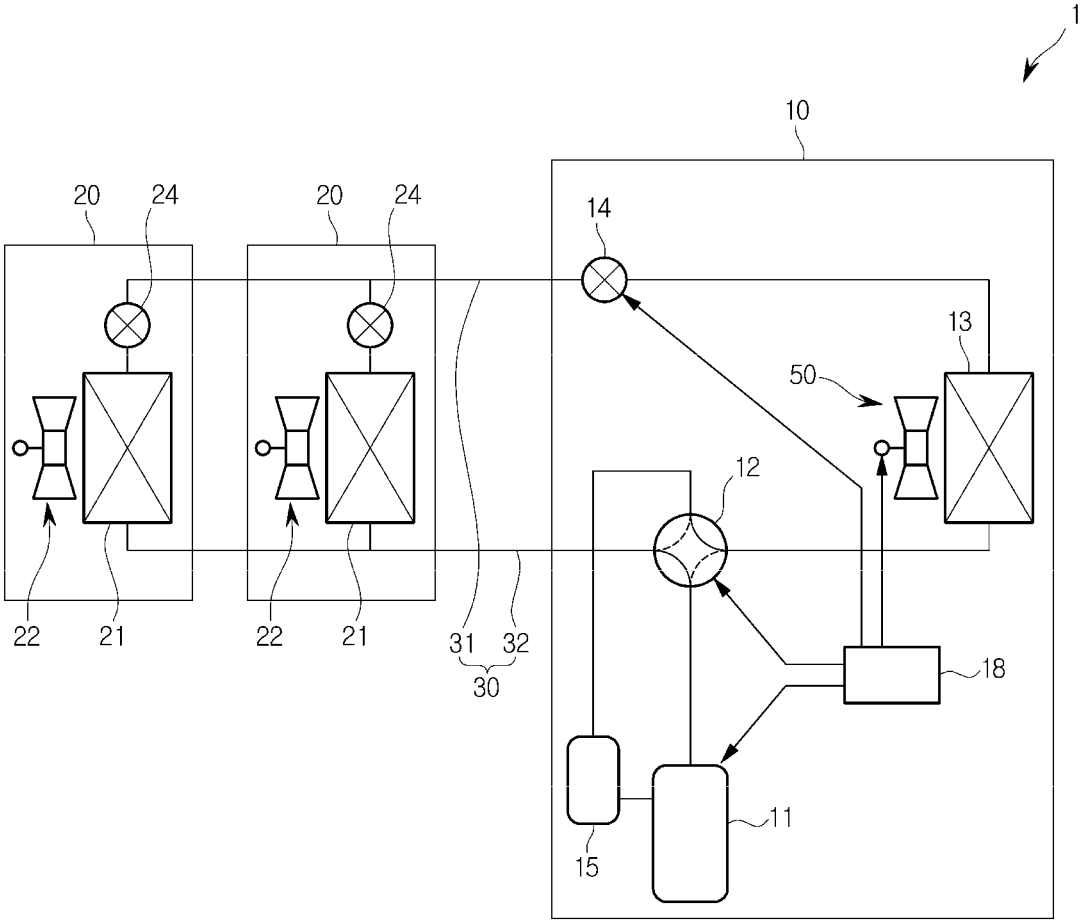
FIG. 1 is a schematic configuration diagram of an air conditioner according to an embodiment of the present disclosure.

FIG. 1 is a schematic configuration diagram of an air conditioner 1 to which an embodiment of the present disclosure is applied.

The air conditioner 1 includes, for example, an outdoor unit 10 installed on a roof or the like of a building, a plurality of indoor units 20 installed on each part of the building, and a piping 30 connected between the outdoor unit 10 and the indoor units 20 and through which refrigerant circulating to the outdoor unit 10 and the indoor units 20 flows.

The outdoor unit 10 includes a compressor 11 for compressing the refrigerant, a four-way switching valve 12 for switching refrigerant passages, an outdoor heat exchanger 13 which is a device for moving heat from a high temperature object to a low temperature object, an outdoor expansion valve 14 for expanding and evaporating the condensed refrigerant liquid to low pressure/low temperature, and an accumulator 15 for separating the refrigerant liquid which has not been evaporated. The outdoor unit 10 also includes a blower 50 that sends air to the outdoor heat exchanger 13 to promote heat exchange between the refrigerant and the air. The four-way switching valve 12 is connected to the compressor 11, the outdoor heat exchanger 13 and the accumulator 15 by the piping 30, respectively. Also, the compressor 11 and the accumulator 15 are connected by the piping 30 and the outdoor heat exchanger 13 and the outdoor expansion valve 14 are connected by the piping 30. FIG. 1 illustrates a state in which a heating operation is performed in a switched connection state of the four-way switching valve 12.

The outdoor unit 10 is also provided with a control device 18 for controlling the operation of the compressor 11, the outdoor expansion valve 14, and the blower 50 and the like, or for the switching of the four-way switching valve 12.

As illustrated in FIG. 1, each of the indoor unit 20 includes an indoor heat exchanger 21 which is a device for moving heat from a high temperature object to a low temperature object, a blower 22 for sending air to the indoor heat exchanger 21 to promote heat exchange between the refrigerant and the air, and an indoor expansion valve 24 for expanding and evaporating the condensed refrigerant liquid to low pressure/low temperature.

Although two indoor units 20 are connected to one outdoor unit 10 in the example illustrated in FIG. 1, the number of the indoor units 20 may be one, or three or more, and the number of the outdoor units 10 may be plural.

The piping 30 has a liquid refrigerant pipe 31 through which the liquefied refrigerant flows and a gas refrigerant pipe 32 through which the gas refrigerant flows. The liquid refrigerant pipe 31 is arranged such that the refrigerant flows between the indoor expansion valves 24 of the indoor units 20 and the outdoor expansion valve 14. The gas refrigerant pipe 32 is arranged such that the refrigerant passes between the four-way switching valve 12 of the outdoor unit 10 and the gas side of the indoor heat exchangers 21 of the indoor units 20.

Figure 2:
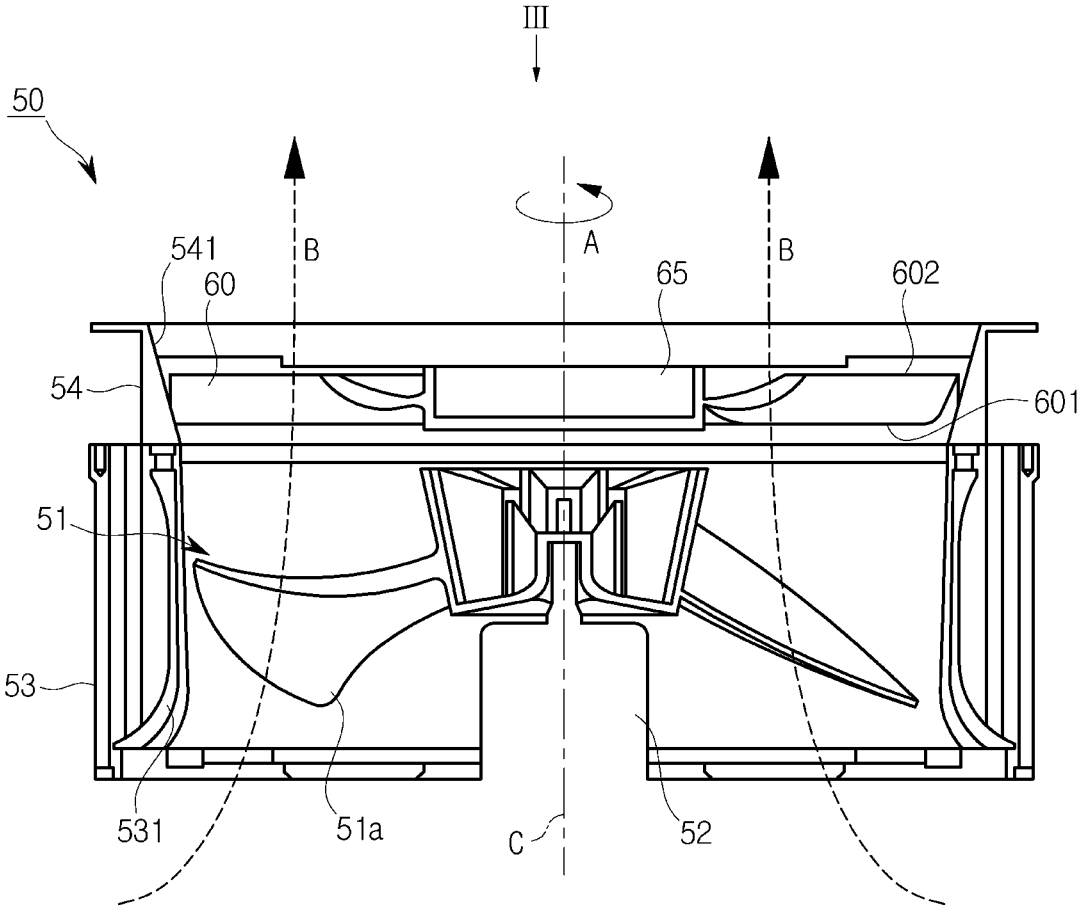
FIG. 2 is a cross-sectional view schematically illustrating a blower according to an embodiment of the present disclosure.
Figure 3:
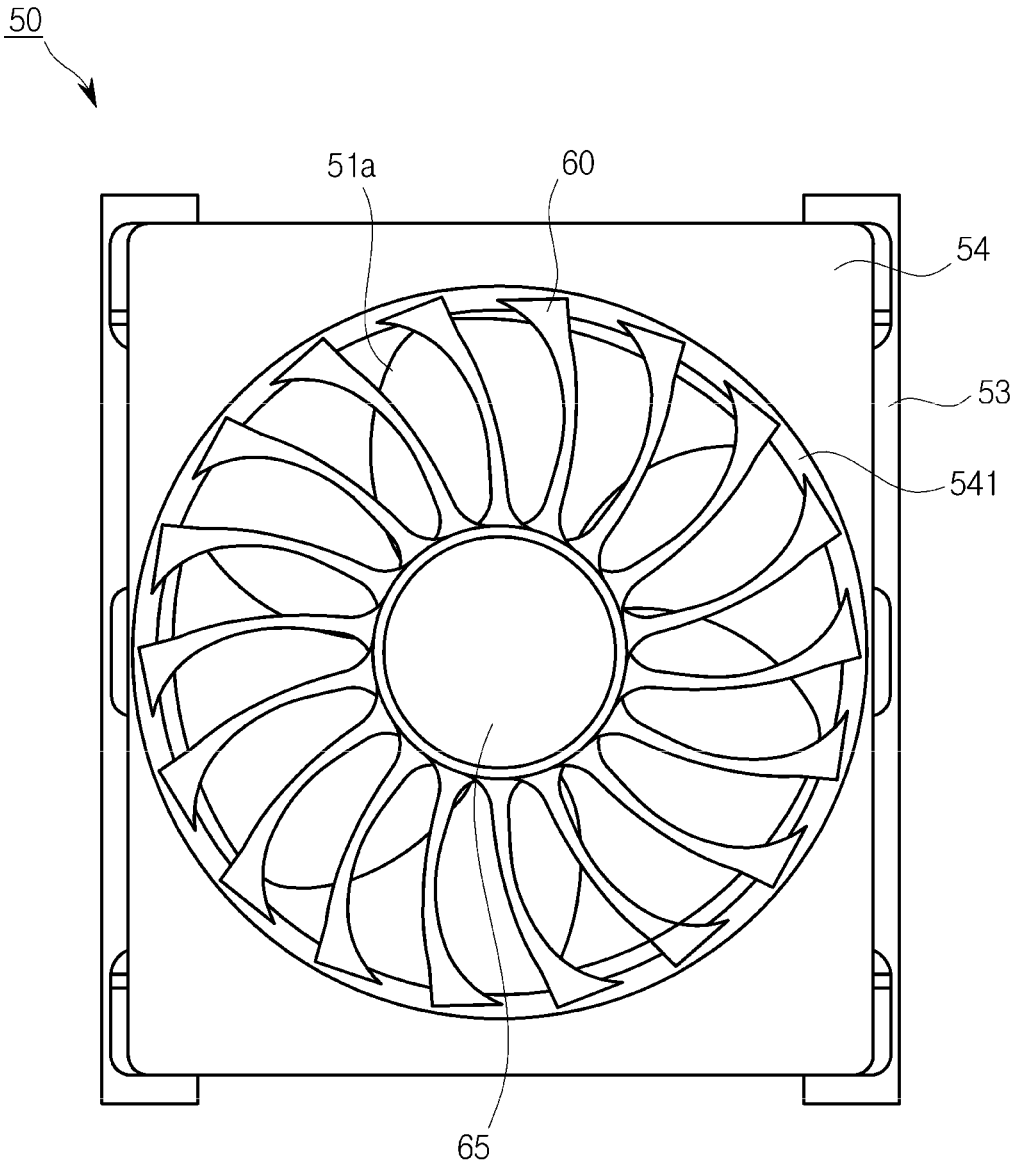
FIG. 3 is a top plan view schematically illustrating a blower according to an embodiment of the present disclosure.

Next, the blower 50 according to the embodiment of the present disclosure will be described. FIG. 2 is a schematic cross-sectional view illustrating the configuration of the blower 50 to which the embodiment of the present disclosure is applied. FIG. 3 is a schematic top plan view illustrating the configuration of the blower 50 to which the embodiment of the present disclosure is applied, and corresponds to the view of the blower 50 of FIG. 2 viewed from direction III.

The blower 50 according to the embodiment of the present disclosure includes a fan 51 for generating an airflow to cool the outdoor heat exchanger 13 (refer to FIG. 1) by rotating in the direction of arrow A about a rotation axis C, an electric motor 52 for driving the fan 51, a first housing 53 to house the fan 51 and the electric motor 52, and a second housing 54 connected to the first housing 53 on the downstream side in the advancing direction of the airflow generated by the fan 51. In the embodiment of the present disclosure, as illustrated in FIG. 3, the fan 51 has three moving blades 51*a*.

Here, the blower 50 according to the embodiment of the present disclosure is installed such that the rotation axis direction of the fan 51 is vertical. Although not shown, in the embodiment of the present disclosure, the above-described outdoor heat exchanger 13 is installed on the vertically lower side than the first housing 53 of the blower 50. In addition, the blower 50 according to the embodiment of the present disclosure is configured such that by the rotation of the fan 51, air is sucked in the vicinity of the outdoor heat exchanger 13, and as shown by the dotted arrow lines B, the airflow flows toward the vertical upward side from the vertical downward side.

The first housing 53 according to the embodiment of the present disclosure has a cylindrical inner wall surface 531, and a flow passage through which the airflow generated by the fan 51 passes along the inner wall surface 531 is formed inside the first housing 53. In the first housing 53 according to the embodiment of the present disclosure, as illustrated in FIG. 2, the flow passage formed along the inner wall surface 531 is formed as a so-called "bell-mouth" shape such that the cross-sectional area becomes larger as it goes toward the upstream side (upward in FIG. 2) in the advancing direction of the airflow from the downstream side (downward in FIG. 2) in the advancing direction of the airflow.

Also, the second housing 54 according to the embodiment of the present disclosure has a cylindrical inner wall surface 541, and a flow passage through which the airflow after passing through the first housing 53 passes along the inner wall surface 541 is formed inside the second housing 54. As illustrated in FIG. 2, in the second housing 54 according to the embodiment of the present disclosure, the flow passage formed along the inner wall surface 541 has an expanded opening shape in which the cross-sectional area becomes larger as it goes toward the downstream side (upward in FIG. 2) in the advancing direction of the airflow from the upstream side (downward in FIG. 2) in the advancing direction of the airflow.

Further, a plurality of stationary blades 60 extending from the inner wall surface 541 toward the rotation axis C, and a connecting member installed at the vicinity of the rotation axis C to connect with the plurality of stationary blades 60 are formed on the second housing 54 according to the embodiment of the present disclosure. In other words, as illustrated in FIG. 2, the second housing 54 according to the embodiment of the present disclosure is provided with the plurality of stationary blades 60 installed radially toward the inner wall surface 541 from a connecting member 65. Here, each of the stationary blades 60 has a plate shape with a substantially uniform thickness from the connecting member 65 side to the inner wall surface 541 side. Also, in the embodiment of the present disclosure, the plurality of stationary blades 60 has the same shape as each other.

Further, although a detailed description will be given later, in the blower 50 according to the embodiment of the present disclosure, the airflow generated by the rotation of the fan 51 and blown out of the first housing 53 passes through the gaps (spaces) between the plurality of stationary blades 60 formed at the second housing 54 and is discharged to the outside of the blower 50.

Here, in the stationary blade 60, the edge of the side which is opposed to the fan 51 and into which the airflow generated by the rotation of the fan 51 enters is referred to as an inlet edge 601, and the edge located on the side opposite to the inlet edge 601 and from which the airflow is discharged is referred to as an outlet edge 602.

Figure 4:
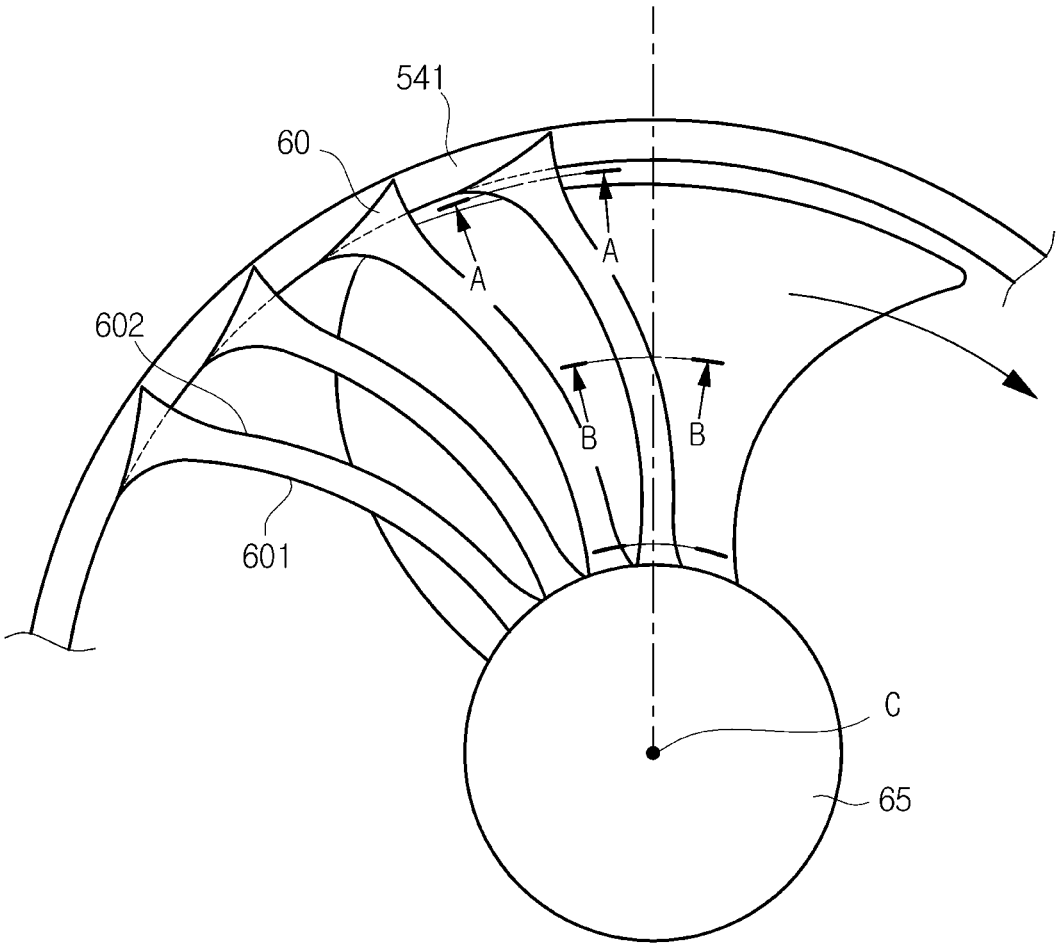
FIG. 4 is a view for explaining a relationship between stationary blades and a fan according to an embodiment of the present disclosure.

FIG. 4, which is a view for explaining a relationship between the stationary blades 60 and the fan 51 to which the embodiment of the present disclosure is applied, illustrates the stationary blades 60 and the fan 51 viewed from the downstream side in the direction of the rotation axis of the fan 51.

As illustrated in FIG. 4, as each stationary blade 60 goes toward the outer circumferential portion connected to the inner wall surface 541 from the inner circumferential portion connected to the connecting member 65, each stationary blade 60 is formed in a shape curved opposite to a rotation direction A of the fan 51 such that the radial center portion becomes convex when viewed from the downstream side in the direction of the rotation axis. That is, as illustrated in FIG. 4, each stationary blade 60 is formed in a shape curved opposite to the rotation direction A of the fan 51 relative to a straight line (one-dot chain line in FIG. 4) passing through the rotation center (rotation axis C) of the fan 51 and the connecting portion between the stationary blade 60 and the connecting member 65 and extending to the inner wall surface 541.

Further, as illustrated in FIG. 4, each of the stationary blades 60 is formed such that the outlet edge 602 is biased in the rotation direction A relative to the inlet edge 601 when viewed from the downstream side in the direction of the rotation axis. That is, each of the stationary blades 60 has a shape inclined in the rotation direction A as it goes from the inlet edge 601 to the outlet edge 602.

In the description of the present specification, as a direction along the rotation axis C of the fan 51, the direction from the lower side toward the upper side in FIG. 2 may be simply referred to as a rotation axis direction. Also, as a direction perpendicular to the rotation axis, the direction from the rotation axis C toward the inner wall surface 531 or the inner wall surface 541 may be referred to as a radial direction. Also, the radially inner side (the rotation axis C side) of the fan 51 or the stationary blades 60 or the like may be referred to as an inner circumferential side (inner circumferential portion) and the radially outer side (the inner wall surfaces 531 and 541 side) may be referred to as an outer circumferential side (outer circumferential portion).

Figure 5:
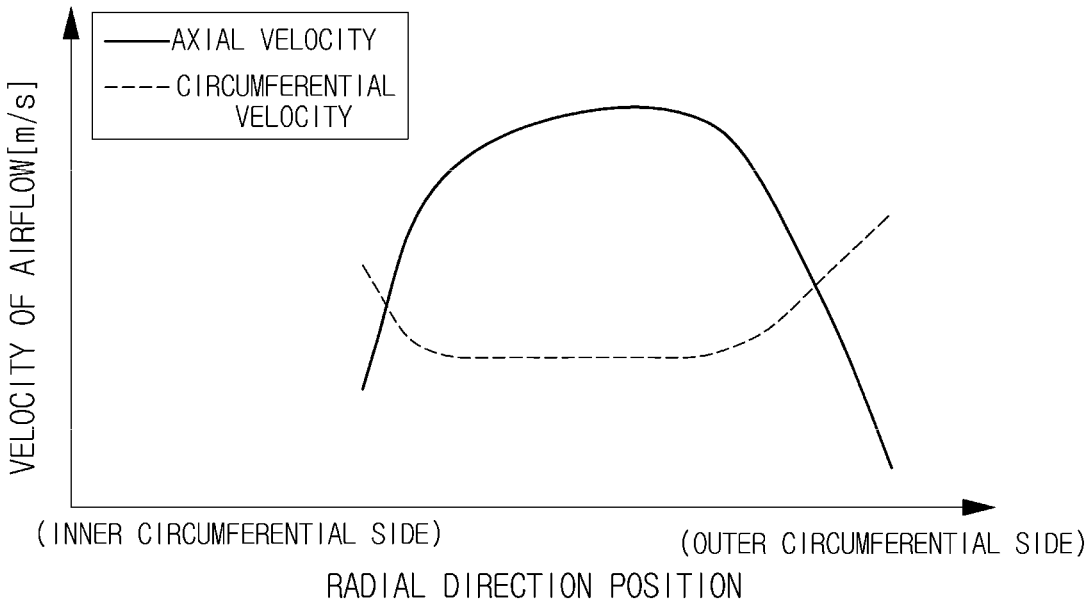
FIG. 5 illustrates a radial distribution of the velocity of the airflow generated by the rotation of the fan according to an embodiment of the present disclosure.

Next, the airflow generated by the rotation of the fan 51 will be described. FIG. 5 is a diagram illustrating radial distributions of the velocity of the airflow generated by the rotation of the fan 51 according to the embodiment of the present disclosure. Specifically, FIG. 5 illustrates radial distributions of the axial velocity and the circumferential velocity of the airflow generated by the rotation of the fan 51 and blown out of the first housing 53 in the blower 50 according to the embodiment of the present disclosure.

In the embodiment of the present disclosure, the airflow generated by the rotation of the fan 51 is blown in the form of a spiral from the first housing 53. In other words, the airflow generated by the rotation of the fan 51 has circumferential components directed to the rotation direction A in addition to axial components toward the downstream side in the rotation axis direction. In FIG. 5, the velocity of the axial components in the airflow generated by the rotation of the fan 51 is taken as the axial velocity, and the velocity of the circumferential components is taken as the circumferential velocity.

As illustrated in FIG. 5, in the embodiment of the present disclosure, the axial velocity of the airflow generated by the rotation of the fan 51 becomes smaller in the inner circumferential portion and the outer circumferential portion of the blower 50 than in the radial center portion located between the inner circumferential portion and the outer circumferential portion. Also, the circumferential velocity of the airflow generated by the rotation of the fan 51 becomes larger in the inner circumferential portion and the outer circumferential portion of the blower 50 than in the radial center portion.

That is, in the airflow blown from the inner circumferential portion and the outer circumferential portion of the first housing 53, the circumferential direction components are increased compared with the airflow blown from the radial center portion of the first housing 53. Also, in the blower 50 according to the embodiment of the present disclosure, the airflow blown from the inner circumferential portion and the outer circumferential portion of the first housing 53 is in an inclined state in the rotation direction A (circumferential direction) of the fan 51 in comparison with the airflow blown from the radial center portion of the first housing 53.

Next, the shape of the stationary blades 60 according to the embodiment of the present disclosure will be described in more detail.

Figure 6:
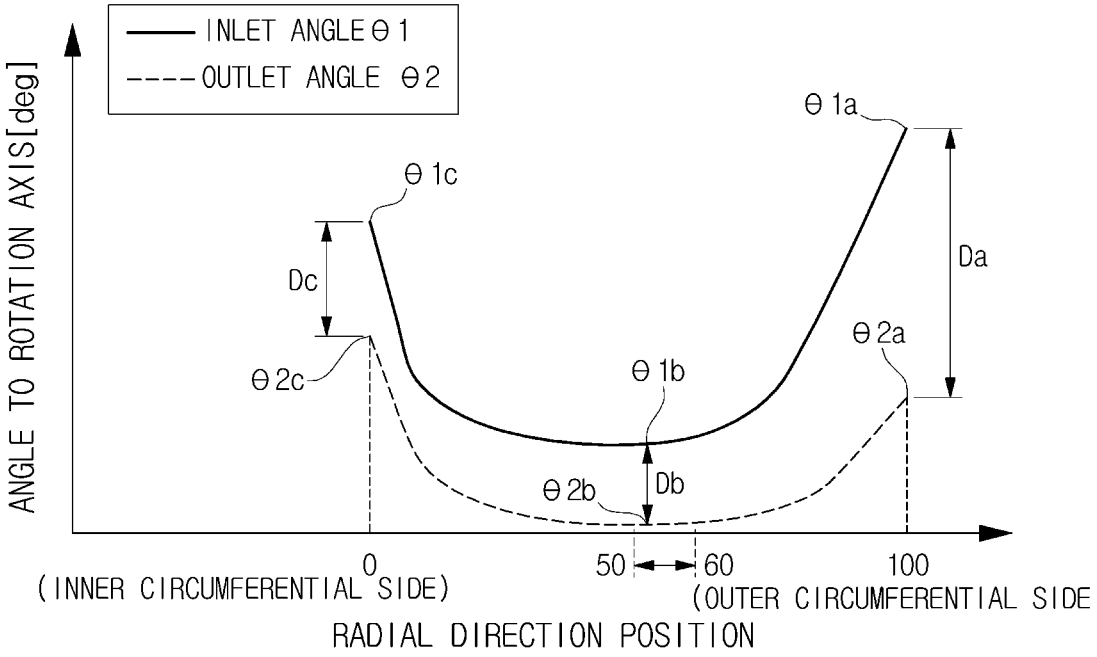
FIG. 6 illustrates a change in an inlet angle and an outlet angle in a stationary blade depending on radial direction positions according to an embodiment of the present disclosure.

FIG. 6 is a diagram illustrating changes in an inlet angle (θ1) and an outlet angle (θ2) in the stationary blade 60 to which the embodiment of the present disclosure is applied, by the radial direction positions. Also, FIGS. 7*a* to 7*c* and FIGS. 8*a* to 8*c*, which are diagrams illustrating the cross-sectional shapes of the stationary blade 60, illustrate the cross-sectional shapes of the stationary blade 60 according to the rotation direction A of the fan 51. Here, FIGS. 7*a* and 8*a* correspond to cross-sectional views taken along line A-A in FIG. 4 and illustrate cross-sectional shapes at the outer circumferential portion of the stationary blade 60. Also, FIGS. 7*b* and 8*b* correspond to cross-sectional views taken along line B-B in FIG. 4 and illustrate cross-sectional shapes at the radial center portion of the stationary blade 60. Also, FIGS. 7*c* and 8*c* correspond to cross-sectional views taken along line C-C in FIG. 4 and illustrate cross-sectional shapes at the inner circumferential portion of the stationary blade 60.

In the embodiment of the present disclosure, the inlet angle (θ1) of the stationary blade 60 denotes the angle formed by the inlet edge 601 of the stationary blade 60 and the rotation axis C of the fan 51, and the outlet angle (θ2) of the blade 60 denotes the angle formed by the outlet edge 602 of the stationary blade 60 and the rotation axis C of the fan 51.

Figure 7A:
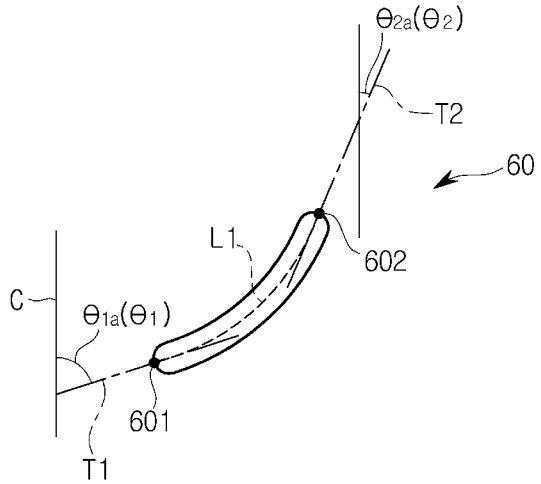
FIGS. 7*a* to 7*c* illustrate inlet angles and outlet angles according to radial direction positions of a stationary blade.
Figure 7B:
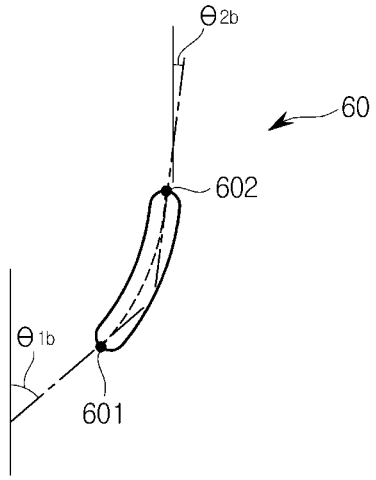
Figure 7C:
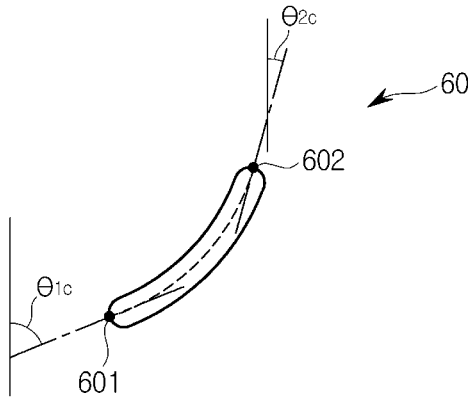

Specifically, as illustrated in FIG. 7*a*, a center line L passing through the center of the thickness of the stationary blade 60 in a cross section of the stationary blade 60 is drawn from the inlet edge 601 to the outlet edge 602. As described above, the stationary blade 60 is in the form of a plate having a substantially uniform thickness and has a curved shape from the inlet edge 601 to the outlet edge 602. Corresponding to this, the center line L1 becomes a curved line as illustrated in FIG. 7*a*.

In the embodiment of the present disclosure, the angle formed by a tangential line T1 of the center line L1 at the inlet edge 601 and the rotation axis C on a cross section of the stationary blade 60 is defined as the inlet angle (θ1). Similarly, an angle formed by a tangential line T2 of the center line L1 at the outlet edge 602 and the rotation axis C on a cross section of the stationary blade 60 is defined as the outlet angle (θ2).

Although the details will be described later, in the stationary blade 60 according to the embodiment of the present disclosure, as illustrated in FIG. 6, the outlet angle (θ2) is smaller and closer to the rotation axis direction, compared with the inlet angle (θ1).

In the blower 50 according to the embodiment of the present disclosure, the stationary blade 60 having such a shape changes the advancing direction of the airflow to the rotational axis direction to recover the dynamic pressure in the process of introducing the airflow generated by the rotation of the fan 51 from the inlet edge 601 of the stationary blade 60 and discharging the airflow toward the outlet edge 602.

As illustrated in FIG. 6, in the embodiment of the present disclosure, the inlet angle (θ1) of the stationary blade 60 continuously changes in accordance with the radial position such that it corresponds to the velocity distributions (distributions of the axial velocity and the circumferential velocity; refer to FIG. 5) of the airflow generated by the fan 51.

Specifically, the inlet angle (θ1) of the stationary blade 60 becomes large at the outer circumferential portion and the inner circumferential portion where the axial velocity of the airflow generated by the fan 51 is low and the blowing direction of the airflow is inclined in the rotating direction A (the circumferential direction), as compared with the radial center portion. On the contrary, the inlet angle (θ1) of the stationary blade 60 becomes small at the radial center portion where the axial velocity of the airflow generated by the fan 51 is large and the blowing direction of the airflow is close to the rotation axis direction, as compared with the outer circumferential portion and the inner circumferential portion.

In other words, as illustrated in FIGS. 6 and 7*a* to 7*c*, an inlet angle (θ1*a*) at the outer circumferential portion of the stationary blade 60 and an inlet angle (θ1*c*) at the inner circumferential portion of the stationary blade 60 become larger, as compared with an inlet angle (θ1*b*) at the radial center portion of the stationary blade 60 (θ1*a*>θ1*b*, θ1*c*>θ1*b*).

As such, in the blower 50 according to the embodiment of the present disclosure, since the inlet angle (θ1) of the stationary blade 60 and the blowing direction of the airflow generated by the rotation of the fan 51 have a corresponding relationship, the airflow generated by the rotation of the fan 51 is easily introduced along the stationary blade 60 at the inlet edge 601. Thus, in the embodiment of the present disclosure, the inflow resistance when the airflow generated by the rotation of the fan 51 is introduced into the stationary blade 60 is reduced, so the direction of the airflow is easily changed by the stationary blade 60. As a result, the static pressure efficiency in the blower 50 is improved compared with the case where the configuration of the present disclosure is not employed.

Herein, in the embodiment of the present disclosure, in the case where the innermost circumferential portion of the stationary blade 60 connected to the connecting member 65 is defined as 0 and the outermost circumferential portion connected to the inner wall surface 541 is defined as 100 and the radial direction position of the stationary blade 60 is relatively expressed, as illustrated in FIG. 6, the inlet angle (θ1) is formed to have a minimum value at a portion where the radial direction position (relative value) is 50 to 60.

However, the inlet angle (θ1) of the stationary blade 60 is not limited to the example illustrated in FIG. 6, and may be, for example, selected according to the shape of the fan 51 or the blowing direction of the airflow generated by the rotation of the fan 51 or the like.

Also, in the embodiment of the present disclosure, the outlet angle (θ2) of the stationary blade 60 changes continuously according to the radial direction position such that it corresponds to the inlet angle (θ1) of the stationary blade 60 and the velocity distribution of the airflow generated by the fan 51.

Specifically, as illustrated in FIG. 6, in the stationary blade 60 according to the embodiment of the present disclosure, the outlet angles (θ2) change continuously such that the outlet angles (θ2) of the inner circumferential portion and the outer circumferential portion become large relative to the outlet angle (θ2) of the radial center portion. In other words, in the embodiment of the present disclosure, as illustrated in FIGS. 6 and 7*a* to 7*c*, the outlet angle (θ2*a*) at the outer circumferential portion of the stationary blade 60 and the outlet angle (θ2*c*) at the inner circumferential portion of the stationary blade 60 become large relative to the outlet angle (θ2*b*) at the radial center portion of the stationary blade 60 (θ2*a*>θ2*b*, θ2*c*>θ2*b*).

Also, in the embodiment of the present disclosure, the difference (θ1-θ2) between the inlet angle (θ1) and the outlet (θ2) becomes large at the inner circumferential portion and the outer circumferential portion of the stationary blade 60 compared with the radial center portion of the stationary blade 60. Specifically, as illustrated in FIG. 6, a difference (Da) (=θ1*a*−θ2*a*) at the outer circumferential portion of the stationary blade 60 and the difference Dc (=θ1*c*−θ2*c*) at the inner circumferential portion become larger compared with a difference Db (=θ1*b*−θ2*b*) at the radial center portion of the stationary blade 60 (Da>Db, Dc>Db).

In the embodiment of the present disclosure, for example, the difference Da at the outer circumferential portion of the stationary blade 60 and the difference Dc at the inner circumferential portion can be made larger than 20°, and the difference Db at the radial center portion of the stationary blade 60 can be made less than 20°.

Also, in the example illustrated in FIGS. 6 and 7*a* to 7*c*, the difference Da at the outer circumferential portion of the stationary blade 60 becomes larger than the difference Dc at the inner circumferential portion of the stationary blade 60 (Da>Dc).

Figure 8A:
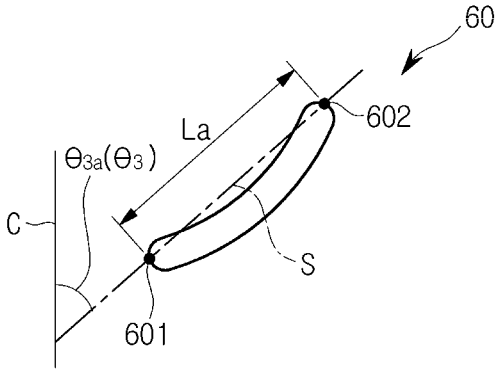
FIGS. 8*a* to 8*c* illustrate chord angles and the length of the chord angles according to radial direction positions of a stationary blade.

On the other hand, as illustrated in FIG. 8*a*, in a cross section of the stationary blade 60 cut in the rotation direction of the fan 51, a straight line connecting the inlet edge 601 and the outlet edge 602 is referred to as a chord S.

Figure 8B:
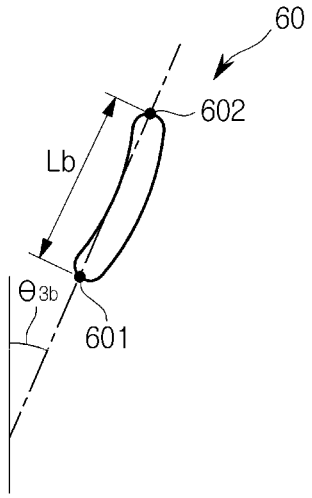
Figure 8C:
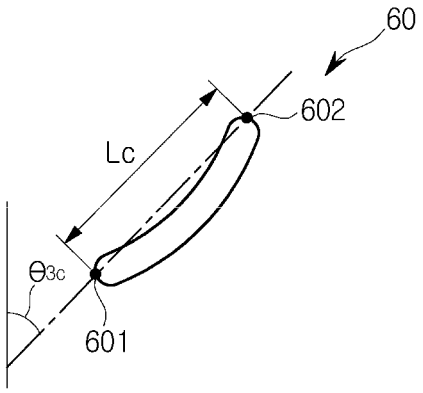

In the stationary blade 60 according to the embodiment of the present disclosure, a chord angle (θ3) formed by the chord S and the rotation axis C changes continuously according to the radial direction position such that it corresponds to the inlet angle (θ1) of the stationary blade 60 and the velocity distribution of the airflow generated by the fan 51. Specifically, as illustrated in FIGS. 8*a* to 8*c*, in the embodiment of the present disclosure, a chord angle (θ3*a*) at the outer circumferential portion of the stationary blade 60 and a chord angle (θ3*c*) at the inner circumferential portion of the stationary blade 60 become large compared with a chord angle (θ3*b*) at the radial center portion of the stationary blade 60 (θ3*a*>θ3*b*, θ3*c*>θ3*b*).

Also, in the stationary blade 60 according to the embodiment of the present disclosure, the length of the chord S changes continuously according to the radial direction position such that it corresponds to the inlet angle (θ1) of the stationary blade 60 and the velocity distribution of the airflow generated by the fan 51. Specifically, as illustrated in FIGS. 8*a* to 8*c*, a length La of a chord Sa at the outer circumferential portion of the stationary blade 60 and a length Lc of a chord Sc at the inner circumferential portion of the stationary blade 60 are longer compared with a length Lb of a chord Sb at the radial center portion of the stationary blade 60 (La>Lb, Lc>Lb).

On the other hand, in the blower 50 having the stationary blade 60 on the downstream side of the blowing direction of the airflow by the fan 51, in the case where the stationary blade 60 has a shape curved rapidly from the inlet edge 601 to the outlet edge 602, there is a tendency that it is difficult to effectively recover the dynamic pressure by the stationary blade 60. That is, in the case where the stationary blade 60 has a shape curved rapidly, the airflow is easily separated from the surface of the stationary blade 60 in the process of moving the airflow introduced from the side of the inlet edge 601 of the stationary blade 60 to the side of the outlet edge 602. When the airflow is separated from the stationary blade 60, it is difficult to change the blowing direction of the airflow by the stationary blade 60, which makes it difficult to effectively recover the dynamic pressure of the airflow.

As described above, in the stationary blade 60, the outlet angle (θ2) is made to be smaller compared with the inlet angle (θ1) in order to change the blowing direction of the airflow introduced from the inlet edge 601 side. Also, in order to reduce the inflow resistance of the airflow to the stationary blade 60, the inlet angle (θ1) is made to be large at the inner circumferential portion and the outer circumferential portion of the stationary blade 60 compared with the radial center portion of the stationary blade 60. Therefore, for example, when the outlet angle (θ2), the chord angle (θ3) and the length of the chord S of the stationary blade 60 are constant regardless of the radial direction position, the stationary blade 60 is likely to be curved rapidly at the inner and outer circumferential portions of the stationary blade 60 having the large inlet angle (θ1) compared with the radial center portion.

In this regard, in the stationary blade 60 according to the embodiment of the present disclosure, as described above, the outlet angle (θ2), the chord angle (θ3) and the length of the chord S are changed in accordance with the radial direction position so as to correspond to the inlet angle (θ1) and the velocity distribution of the airflow generated by the fan 51.

More specifically, in the embodiment of the present disclosure, the outlet angle (θ2) and the chord angle (θ3) at the inner and outer circumferential portions of the stationary blade 60 are made to be large compared with the outlet angle (θ2) and the chord angle (θ3) at the radial center portion, and the length of the chord S at the inner and outer circumferential portions of the stationary blade 60 are made to be longer compared with the length of the chord S at the radial center portion.

By having the stationary blade 60 have such a configuration, in the blower 50 according to the embodiment of the present disclosure, the stationary blade 60 is restrained from being rapidly curved from the inlet edge 601 to the outlet edge 602 even at the inner and outer circumferential portions of the stationary blade 60 having the large inlet angle (θ1).

As a result, in the blower 50 according to the embodiment of the present disclosure, the dynamic pressure of the airflow generated by the rotation of the fan 51 is effectively recovered by the stationary blade 60, and therefore the static pressure efficiency of the blower 50 is improved as compared with the case where the configuration of the present disclosure is not employed.

Also, in the stationary blade 60 according to the embodiment of the present disclosure, since the length of the chord S at the inner and outer circumferential portions is made to be longer compared with the radial center portion, the length from the inlet edge 601 to the outlet edge 602 on the surface of the stationary blade 60 in the outer circumferential portion and the inner circumferential portion of the stationary blade 60 becomes longer. That is, the path through which the airflow generated by the rotation of the fan 51 is guided by the stationary blade 60 at the outer circumferential portion and the inner circumferential portion of the stationary blade 60 becomes longer as compared with the radial center portion of the stationary blade 60.

Therefore, it is possible to effectively change the blowing direction of the airflow even at the outer circumferential portion and the inner circumferential portion having a high circumferential direction component with respect to the airflow generated by the rotation of the fan 51 as compared with the case where the configuration of the present disclosure is not adopted, and so it is possible to more effectively recover the dynamic pressure of the airflow.

On the other hand, as described above, at the radial center portion of the stationary blade 60, the inlet angle (θ1) is small relative to the inner circumferential portion and the outer circumferential portion. For this reason, the outlet angle (θ2) and the chord angle (θ3) at the radial center portion are made smaller as compared with the inner circumferential portion and the outer circumferential portion, and thus even when the length of the chord S is shortened, the stationary blade 60 is not rapidly curved from the inlet edge 601 to the outlet edge 602, so that the problem caused by the rapid curving of the stationary blade 60 is unlikely to occur.

Also, as described above, the proportion of the axial component in the airflow generated by the rotation of the fan 51 becomes high at the radial center portion as compared with the inner circumferential portion and the outer circumferential portion. In the embodiment of the present disclosure, by having the outlet angle (θ2) and the chord angle (θ3) of the radial center portion be small and having the length of the chord S be shorten as compared with the inner circumferential portion and the outer circumferential portion of the stationary blade 60, the blowing direction of the airflow at the radial center portion can be changed more toward the rotation axis direction as compared with the case where the configuration of the present disclose is not adopted.

Next, another embodiment of the stationary blade 60 of the present disclosure will be described.

Figure 9:
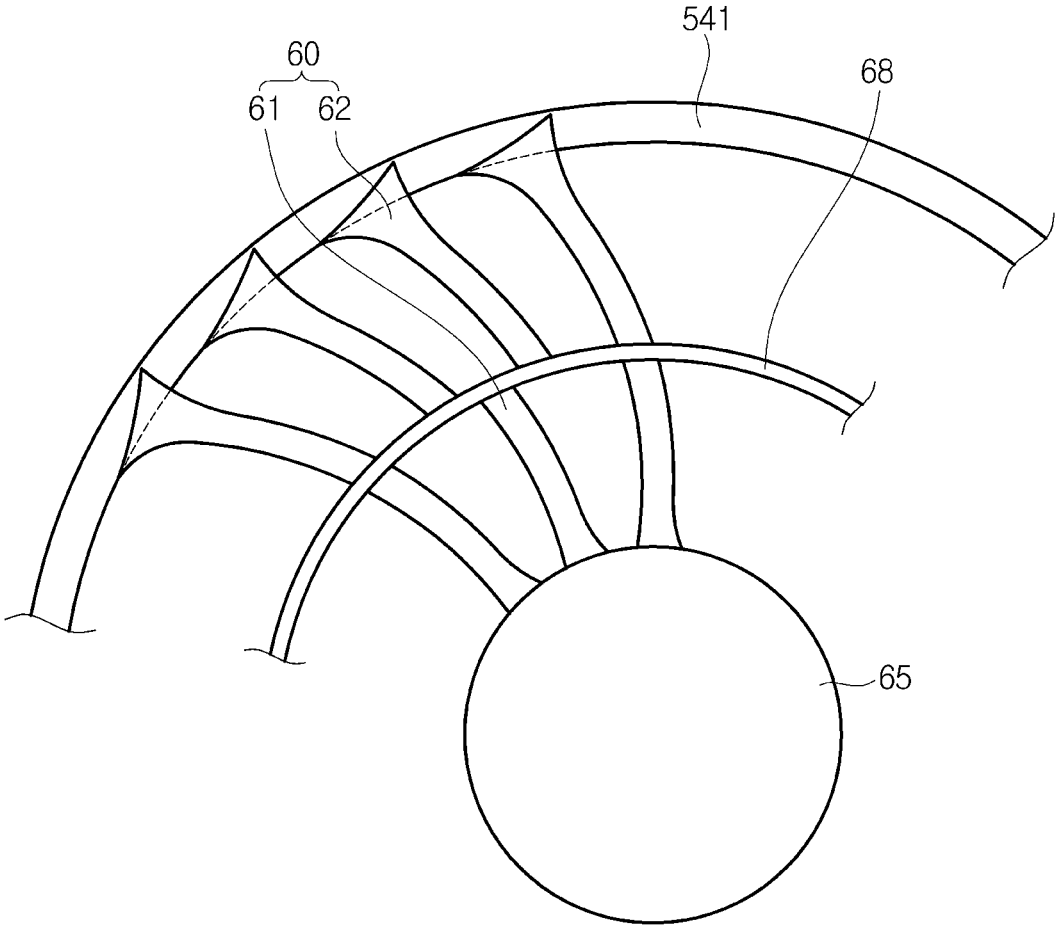
FIG. 9 is a view for explaining a configuration of stationary blades according to another embodiment of the present disclosure.

FIG. 9, which is a view for explaining the configuration of the stationary blades 60 to which another embodiment is applied, is a view showing the stationary blades 60 viewed from the direction of the rotation axis.

As illustrated in FIG. 9, in the embodiment of the present disclosure, the plurality of stationary blades 60 are connected to a radial center portion and have a ring-shaped supporting member 68 for supporting the plurality of stationary blades 60. Also, in the embodiment of the present disclosure, the stationary blades 60 are divided into a plurality of inner circumferential stationary blades 61 extending from the connecting member 65 to the supporting member 68 by the supporting member 68 and a plurality of outer circumferential stationary blades 61 extending from the supporting member 68 to the inner wall surface 541. Also, in the embodiment of the present disclosure, each of the inner circumferential stationary blades 61 has the same shape, and each of the outer circumferential stationary blades 62 has the same shape.

In the blower 50 according to the embodiment of the present disclosure, by providing the supporting member 68 at the radial center portion of the stationary blades 60, the strength of the stationary blades 60 is improved as compared with the case where the configuration of the present disclosure is not adopted. Also, for example, since the strength of the stationary blades 60 can be maintained even when the stationary blades 60 are manufactured using a low-cost manufacturing method such as resin molding, the cost of the blower 50 is reduced.

Herein, in the stationary blades 60 according to the embodiment of the present disclosure as well, as in the example shown in FIG. 4 and the like, the shapes of the inner circumferential stationary blades 61 and the outer circumferential stationary blades 62 continuously change in the radial direction to correspond to the radial distribution of the velocity of the airflow generated by the rotation of the fan 51. That is, in the embodiment of the present disclosure, the shape in which the inner circumferential stationary blade 61 and the outer circumferential stationary blade 62 are connected has the same shape as the stationary blade 60 shown in FIG. 4 and the like.

Specifically, the inner circumferential stationary blades 61 have the larger inlet angle (θ1) (refer to FIG. 5), the larger outlet angle (θ2) (refer to FIG. 5) and the larger chord angle (θ3) (refer to FIG. 8*a*) at the side of the connecting member 65 and have the longer chord S as compared with the side of the supporting member 68. Also, the outer circumferential stationary blades 62 have the larger inlet angle (θ1), the larger outlet angle (θ2) and the larger chord angle (θ3) at the side of the inner wall surface 541 and have the longer chord S as compared with the side of the supporting member 68.

Further, in the stationary blades 60 according to the embodiment of the present disclosure, as illustrated in FIG. 9, a larger number of the outer circumferential stationary blades 62 are provided as compared with the inner circumferential stationary blades 61. Accordingly, the interval between the outer circumferential stationary blades 62 is restrained from becoming too wide as compared with, for example, the case where the inner circumferential stationary blades 61 and the outer circumferential stationary blades 62 are the same in number. As a result, it is possible to effectively change the blowing direction of the airflow generated by the rotation of the fan 51 also at the outer circumferential side (the outer circumferential stationary blade 62) of the stationary blade 60, so that the dynamic pressure is recovered more effectively as compared with the case where the configuration of the present disclosure is not adopted.

Further, in the example illustrated in FIG. 9, the stationary blades 60 are divided into two regions (the inner circumferential stationary blade 61 and the outer circumferential stationary blade 62) by one supporting member 68, but a plurality of supporting members 68 may be provided in the radial direction so that the stationary blades 60 are divided into three or more regions. In this case, the number of the stationary blades 60 in the three or more respective regions and the interval between the stationary blades 60 may be changed.

Further, in the examples illustrated in FIGS. 2 to 9, the inlet angle (θ1) of the stationary blade 60 is continuously changed in accordance with the radial position. However, in the case where the relationship that the inlet angle (θ1) at the inner circumferential portion and the outer circumferential portion of the stationary blade 60 is larger than the inlet angle (θ1) at the radial center portion is satisfied, the size of the inlet angle (θ1) may be changed stepwise according to the radial direction position of the stationary blade 60. Similarly, the outlet angle (θ2), the chord angle (θ3), the length L of the chord S, and the like of the stationary blade 60 may also be changed stepwise according to the radial direction position of the stationary blade 60.

As described above, in the blower 50 according to the embodiment of the present disclosure, the plurality of stationary blades 60 have a shape that changes in accordance with the radial direction position so as to correspond to the blowing direction of the airflow generated by the rotation of the fan 51. Accordingly, the circumferential direction energy (dynamic pressure) of the airflow generated by the rotation of the fan 51 is effectively recovered by the plurality of stationary blades 60. As a result, in the embodiment of the present disclosure, the static pressure efficiency in the blower 50 is improved as compared with the case where the configuration of the present disclosure is not adopted.

Also, in the embodiment of the present disclosure, the noise generated by the airflow in the blower 50 is reduced as compared with the case where the configuration of the present disclosure is not adopted.

While a blower and an air conditioner having the blower have been described with reference to specific shapes and directions as above, those skilled in the art will appreciate that various modifications and changes are possible, and such various modifications and changes should be construed as being included in the scope of the present disclosure.

[Description of the reference numeral]

| | |
|---|---|
| 1: air conditioner | 10: outdoor unit |
| 20: indoor unit | 50: blower |
| 51: fan | 52: electric motor |
| 53: first housing | 54: second housing |
| 60: stationary blade | 61: inner circumferential blade |
| 62: outer circumferential blade | 65: connecting member |
| 68: supporting member | 601: inlet edge |
| 602: outlet edge | θ1: inlet angle |
| θ2: outlet angle | θ3: chord angle |
| C: rotation axis | S: chord |

The invention claimed is:

1. An air conditioner comprising:

a compressor to compress a refrigerant;

a heat exchanger to move heat of the refrigerant; and a blower to blow air so as to cool the heat exchanger, the blower comprising a fan which is rotated about a rotation axis; and a plurality of stationary blades having a radial shape about the rotation axis in a direction in which the airflow generated by the rotation of the fan is discharged, and being curved in a direction opposite to the rotation direction of the fan as they extend from an inner circumferential portion to an outer circumferential portion, each of the stationary blades having a center line passing through a center of thickness of the stationary blade, each of the blades comprising:

an inlet edge through which the airflow generated by the fan is introduced; and an outlet edge through which the airflow introduced into the inlet edge is discharged, a chord extending between the inlet edge and the outlet edge, wherein an inlet angle is formed by a tangential line from the rotation axis to the center line and a chord angle is formed by a line extending through the chord to the rotation axis and the rotation axis, and the inlet angle and the chord angle are larger at the inner circumferential portion and the outer circumferential portion of the stationary blade than at a radial center portion between the inner circumferential portion and the outer circumferential portion.

2. The air conditioner according to claim 1, wherein the stationary blades are continuously changed in accordance with the radial direction position such that the velocity distribution of the airflow generated by the rotation of the fan corresponds to the inlet angle as it changes between the inner circumferential portion and the outer circumferential portion.

3. The air conditioner according to claim 2, wherein the stationary blades are continuously changed in accordance with the radial direction position such that the chord angle corresponds to the inlet angle and the velocity distribution of the airflow generated by the rotation of the fan.

4. The air conditioner according to claim 3, wherein the stationary blades have a larger outlet angle which is formed by the outlet edge and the rotation axis, at the inner circumferential portion and the outer circumferential portion than at the radial center portion between the inner circumferential portion and the outer circumferential portion.

5. The air conditioner according to claim 4, wherein the stationary blades have a longer length of the chord at the inner circumferential portion and the outer circumferential portion than at the radial center portion between the inner circumferential portion and the outer circumferential portion.

6. The air conditioner according to claim 5, wherein the stationary blades are continuously changed in accordance with the radial direction position such that the outlet angle and the length of the chord correspond to the inlet angle and the velocity distribution of the airflow generated by the rotation of the fan.

7. The air conditioner according to claim 1, further comprises an electric motor to drive the fan, a first housing to house the fan and the electric motor, and a second housing provided with the stationary blades.

8. The air conditioner according to claim 7, wherein the first housing has a cylindrical inner wall surface, a flow passage through which the airflow generated by the fan passes along the inner wall surface is formed inside the first housing, and the cross-sectional area of the flow passage is reduced along the advancing direction of the airflow.

9. The air conditioner according to claim 7, wherein the second housing has a cylindrical inner wall surface, a flow passage through which the airflow after passing through the first housing passes along the inner wall surface is formed inside the second housing, and the cross-sectional area of the flow passage is increased along the advancing direction of the airflow.

10. The air conditioner according to claim 9, wherein the stationary blades are provided to extend to a connecting member provided adjacent to the rotation axis from the inner wall surface and are provided in a plate shape having a uniform thickness from the inner circumferential portion contacting with the connecting member to the outer circumferential portion contacting with the inner wall surface.

11. The air conditioner according to claim 10, wherein a ring-shaped supporting member to support the stationary blades is provided between the inner wall surface and the connecting member, and the stationary blades comprise inner circumferential stationary blades connecting the connecting member and the supporting member, and outer circumferential stationary blades connecting the supporting member and the inner wall surface.

12. The air conditioner according to claim 11, wherein the outer circumferential stationary blades are provided to have a larger number than the number of the inner circumferential stationary blades.

13. An air conditioner comprising:

a compressor to compress a refrigerant;

a heat exchanger to move heat of the refrigerant; and a blower to blow air so as to cool the heat exchanger, the blower comprising a fan which is rotated about a rotation axis; and a plurality of stationary blades having a radial shape about the rotation axis in a direction in which the airflow generated by the rotation of the fan is discharged, and being curved in a direction opposite to the rotation direction of the fan as they extend from an inner circumferential portion to an outer circumferential portion, each of the stationary blades having a center line passing through a center of thickness of the stationary blade, each of the blades comprising:

an inlet edge through which the airflow generated by the fan is introduced; and an outlet edge through which the airflow introduced into the inlet edge is discharged, a chord extending between the inlet edge and the outlet edge, wherein an inlet angle formed by a tangential line from the rotation axis to the center line is larger at the inner circumferential portion and the outer circumferential portion than at a radial center portion between the inner circumferential portion and the outer circumferential portion of the stationary blade, and the length of a chord connecting the inlet edge and the outlet edge is longer at the inner circumferential portion and the outer circumferential portion than at the radial center portion.

14. A blower comprising:

a fan which is rotated about a rotation axis; and a plurality of stationary blades having a radial shape about the rotation axis in a direction in which the airflow generated by the rotation of the fan is discharged, and being curved in a direction opposite to the rotation direction of the fan as they extend from an inner circumferential portion to an outer circumferential portion, each of wherein the stationary blades having a center line passing through a center of thickness of the stationary blade, each of the stationary blades comprising:

an inlet edge through which the airflow generated by the fan is introduced, and an outlet edge through which the airflow introduced into the inlet edge is discharged, wherein an inlet angle formed by a tangential line from the rotation axis to the center line and a chord angle formed by a line extending through a chord connecting the inlet edge and the outlet edge and the rotation axis, and the inlet angle and the chord angle are larger at the inner circumferential portion and the outer circumferential portion of the stationary blade than at the radial center portion between the inner circumferential portion and the outer circumferential portion.

15. A blower comprising:

a fan which is rotated about a rotation axis; and a plurality of stationary blades having a radial shape about the rotation axis in a direction in which the airflow generated by the rotation of the fan is discharged, and being curved in a direction opposite to the rotation direction of the fan as they extend from an inner circumferential portion to an outer circumferential portion, each of the stationary blades having a center line passing through a center of thickness of the stationary blade, each of the stationary blades comprising:

an inlet edge through which the airflow generated by the fan is introduced; and an outlet edge through which the airflow introduced into the inlet edge is discharged, a chord extending between the inlet edge and the outlet edge, wherein an inlet angle is formed by a tangential line from the rotation axis to the center line and is larger at the inner circumferential portion and the outer circumferential portion than at the radial center portion between the inner circumferential portion and the outer circumferential portion of the stationary blade, and the length of a chord connecting the inlet edge and the outlet edge is longer at the inner circumferential portion and the outer circumferential portion than at the radial center portion.

* * * * *